US011041353B2

(12) United States Patent
Miller et al.

(10) Patent No.: US 11,041,353 B2
(45) Date of Patent: Jun. 22, 2021

(54) TUBULAR CUTTING TOOL

(71) Applicant: Weatherford Technology Holdings, LLC, Houston, TX (US)

(72) Inventors: James Robert Miller, Webster, TX (US); Dan Hugh Blankenship, Shoreacres, TX (US); Jeremy Lee Stone, Houston, TX (US); David W. Teale, Spring, TX (US)

(73) Assignee: WEATHERFORD TECHNOLOGY HOLDINGS, LLC, Houston, TX (US)

( * ) Notice: Subject to any disclaimer, the term of this patent is extended or adjusted under 35 U.S.C. 154(b) by 6 days.

(21) Appl. No.: 16/447,620

(22) Filed: Jun. 20, 2019

(65) Prior Publication Data

US 2019/0301255 A1 Oct. 3, 2019

Related U.S. Application Data

(62) Division of application No. 15/136,540, filed on Apr. 22, 2016, now Pat. No. 10,370,921.

(60) Provisional application No. 62/152,525, filed on Apr. 24, 2015.

(51) Int. Cl.
*E21B 29/00* (2006.01)

(52) U.S. Cl.
CPC ..... *E21B 29/005* (2013.01)

(58) Field of Classification Search
CPC ..... E21B 29/00–005
USPC ..... 408/69, 97
See application file for complete search history.

(56) References Cited

U.S. PATENT DOCUMENTS 1,339,641 A * 5/1920 Wright ..... E21B 29/005 166/55.7
2,705,998 A * 4/1955 Spang ..... E21B 29/00 166/55.3
2,761,196 A 9/1956 Graves et al.
3,110,084 A * 11/1963 Kinzbach ..... B23C 5/2265 408/231
3,224,507 A * 12/1965 Cordary ..... E21B 29/005 166/55.8
3,293,963 A * 12/1966 Carroll ..... B23D 21/14 83/54
3,302,983 A * 2/1967 Garrett ..... E21B 17/1057 175/325.2

(Continued)

FOREIGN PATENT DOCUMENTS

CN 204024554 U 12/2014
EP 0353962 A2 2/1990

(Continued)

OTHER PUBLICATIONS

European Search Report in related application EP20174088.3 dated Sep. 2, 2020.

(Continued)

*Primary Examiner* — Steven A MacDonald
(74) *Attorney, Agent, or Firm* — Patterson + Sheridan, LLP

(57) ABSTRACT

A method of cutting a tubular includes providing a rotatable cutting tool in the tubular, the cutting tool having a blade with a cutting structure thereon; extending the blade relative to the cutting tool; rotating the cutting tool relative to the tubular; guiding the cutting structure into contact with the tubular; cutting the tubular using the blade; and limiting extension of the blade.

15 Claims, 8 Drawing Sheets

(56) References Cited

U.S. PATENT DOCUMENTS

| | | | | |
|---|---|---|---|---|
| 3,351,134 | A * | 11/1967 | Kammerer, Jr. | E21B 29/005 166/55.8 |
| 3,859,877 | A * | 1/1975 | Sherer | E21B 29/005 82/82 |
| 4,710,074 | A | 12/1987 | Springer | |
| 4,938,291 | A | 7/1990 | Lynde et al. | |
| 5,265,675 | A * | 11/1993 | Hearn | E21B 10/322 166/297 |
| 5,373,900 | A | 12/1994 | Lynde et al. | |
| 5,771,942 | A | 6/1998 | Bunger | |
| 5,771,972 | A | 6/1998 | Dewey et al. | |
| 5,887,668 | A | 3/1999 | Haugen et al. | |
| 5,979,571 | A | 11/1999 | Scott et al. | |
| 6,568,492 | B2 | 5/2003 | Thigpen et al. | |
| 6,612,383 | B2 | 9/2003 | Desai et al. | |
| 6,626,074 | B1 * | 9/2003 | Wheeler | B23D 45/128 166/117 |
| 6,679,328 | B2 | 1/2004 | Davis et al. | |
| 7,178,609 | B2 | 2/2007 | Hart et al. | |
| 7,624,818 | B2 | 12/2009 | McClain et al. | |
| 7,954,570 | B2 | 6/2011 | McClain et al. | |

FOREIGN PATENT DOCUMENTS

| | | | |
|---|---|---|---|
| GB | 2316965 | A | 3/1998 |
| WO | 2013166435 | A1 | 11/2013 |

OTHER PUBLICATIONS

Australian Examination Report dated May 11, 2020, for Australian Patent Application No. 2016250768.

Trahan et al., "One-trip casing exit milling saves time during complex drilling," Offshore Magazine, Apr. 9, 2014, vol. 74, Issue 4, pp. 82-85.

PCT International Search Report and Written Opinion dated Jul. 4, 2016, for International Applicatoin No. PCT/US2016/028869.

PCT International Preliminary Report on Patentability dated Nov. 2, 2017, for International Application No. PCT/US2016/028869.

EPO Office Action dated May 7, 2019, for European Patent Application No. 16720642.4.

CA Office Action dated Dec. 30, 2020, for Canadian Patent Application No. 2982257.

* cited by examiner

TUBULAR CUTTING TOOL

BACKGROUND OF THE INVENTION

Field of the Invention

The present disclosure generally relates to a tool for cutting a tubular in a wellbore.

Description of the Related Art

A wellbore is formed to access hydrocarbon bearing formations, e.g. crude oil and/or natural gas, by the use of drilling. Drilling is accomplished by utilizing a drill bit that is mounted on the end of a tubular string, such as a drill string. To drill within the wellbore to a predetermined depth, the drill string is often rotated by a top drive or rotary table on a surface platform or rig, and/or by a downhole motor mounted towards the lower end of the drill string. After drilling to a predetermined depth, the drill string and drill bit are removed, and a section of casing is lowered into the wellbore. An annulus is thus formed between the string of casing and the formation. The casing string is temporarily hung from the surface of the well. The casing string is cemented into the wellbore by circulating cement into the annulus defined between the outer wall of the casing and the borehole. The combination of cement and casing strengthens the wellbore and facilitates the isolation of certain areas of the formation behind the casing for the production of hydrocarbons.

It is common to employ more than one string of casing in a wellbore. In this respect, the well is drilled to a first designated depth with the drill string. The drill string is removed. A first string of casing is then run into the wellbore and set in the drilled-out portion of the wellbore, and cement is circulated into the annulus behind the casing string. Next, the well is drilled to a second designated depth, and a second string of casing or liner, is run into the drilled-out portion of the wellbore. If the second string is a liner string, the liner is set at a depth such that the upper portion of the second string of casing overlaps the lower portion of the first string of casing. The liner string may then be fixed, or "hung" off of the existing casing by the use of slips which utilize slip members and cones to frictionally affix the new string of liner in the wellbore. If the second string is a casing string, the casing string may be hung off of a wellhead. This process is typically repeated with additional casing/liner strings until the well has been drilled to total depth. In this manner, wells are typically formed with two or more strings of casing/liner of an ever-decreasing diameter.

In certain operations, it is desirable to remove the innermost string of casing/liner from the wellbore by cutting the innermost casing/liner. Conventional approaches to cutting the innermost casing/liner may cause damage to the next-largest casing/liner. Therefore, there is a need for an apparatus and method of cutting the innermost liner without damaging the next-largest casing/liner.

SUMMARY OF THE INVENTION

A method of cutting a tubular includes providing a rotatable cutting tool in the tubular, the cutting tool having a blade with a cutting structure thereon; extending the blade relative to the cutting tool; rotating the cutting tool relative to the tubular; guiding the cutting structure into contact with the tubular; cutting the tubular using the blade; and limiting extension of the blade.

A rotatable blade for cutting a tubular includes a blade body extendable from a retracted position; a cutting structure disposed on a leading edge of the blade body, the cutting structure configured to cut the tubular; a stop on a first surface of the blade body; and an initial engagement point on a second surface of the blade body, the initial engagement point configured to guide the cutting structure into contact with the tubular.

A method of cutting a tubular includes positioning a rotatable cutting tool in the tubular, the cutting tool having a blade and a cutting structure; extending the blade relative to the cutting tool; rotating the cutting tool relative to the tubular; guiding the cutting structure into contact with the tubular; cutting the tubular using the cutting structure; and limiting a sweep of the cutting structure.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

In the description of the representative embodiments of the invention, directional terms, such as "above", "below", "upper", "lower", etc., are used for convenience in referring to the accompanying drawings. In general, "above", "upper", "upward" and similar terms refer to a direction toward the earth's surface along a longitudinal axis of a wellbore, and "below", "lower", "downward" and similar terms refer to a direction away from the earth's surface along the longitudinal axis of the wellbore.

Figure 1A:
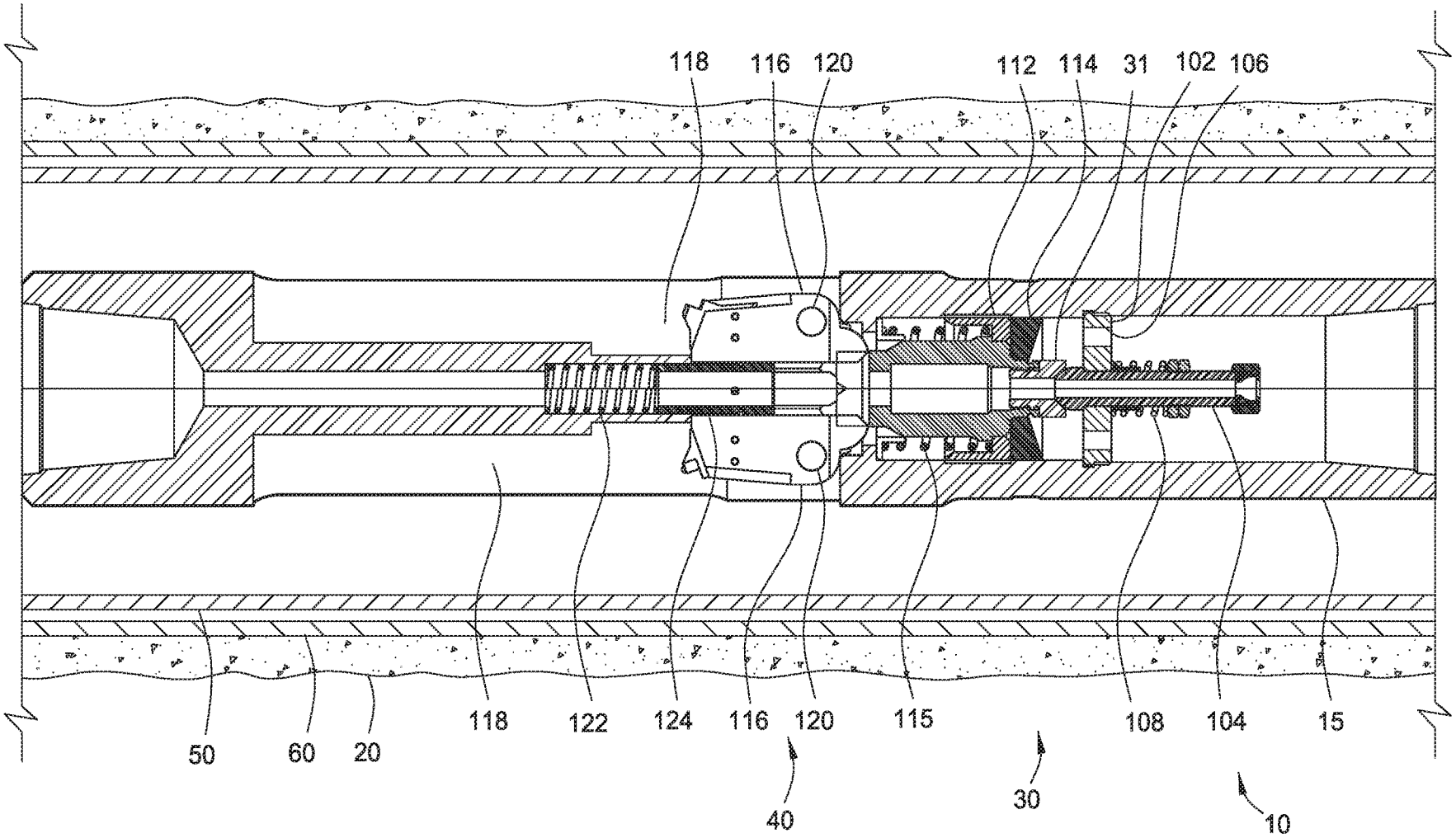
FIG. 1A illustrates a cross sectional view of an embodiment of a tool for selectively cutting an inner tubular, the tool being in a first position.

FIG. 1A illustrates a rotatable cutting tool 10 for cutting a tubular in a wellbore 20. The tubular may be an inner tubular 50 at least partially disposed in an outer tubular 60, as shown in FIG. 1A. However tool 10 may be equally well used in tubulars that are not surrounded by any other tubulars. Exemplary tubulars include casing, liner, drill pipe, drill collars, coiled tubing, production tubing, pipeline, riser, and other suitable wellbore tubulars. The tool 10 includes an actuation assembly 30 and a blade assembly 40 both shown in FIG. 1A positioned in a housing 15. The tool 10 is configured to be disposed within a tubular such that the longitudinal axis of the tool 10 is essentially parallel (within +/−10°) with the longitudinal axis of the tubular. The tool 10 is configured to rotate around its longitudinal axis.

The actuation assembly 30 acts to extend blades 116 of the blade assembly 40. In one embodiment, actuation assembly 30 includes a retaining member 102 having at least one aperture 106 and a bore therethrough. The bore of the retaining member 102 is configured to receive a movable member 104. The movable member 104 includes a bore therethrough. In one embodiment, the movable member 104 is biased upward, for example by a spring 108. The movable member 104 includes a thick bottom portion that prevents disengagement from the retaining member 102. In one embodiment, a bottom surface of the movable member 104 is initially sealingly engaged with a bushing 31 which is threadedly engaged with a piston 112, each having a bore therethrough. The bore of the bushing 31 and the piston 112 have a larger diameter than the bore of the movable member 104. The piston 112 includes a packing seal 114 for preventing fluid flow around the piston 112. In one embodiment, the piston 112 is biased upward against the bottom surface of the movable member 104, for example by a spring 115, as shown in FIG. 1A.

Figure 1B:
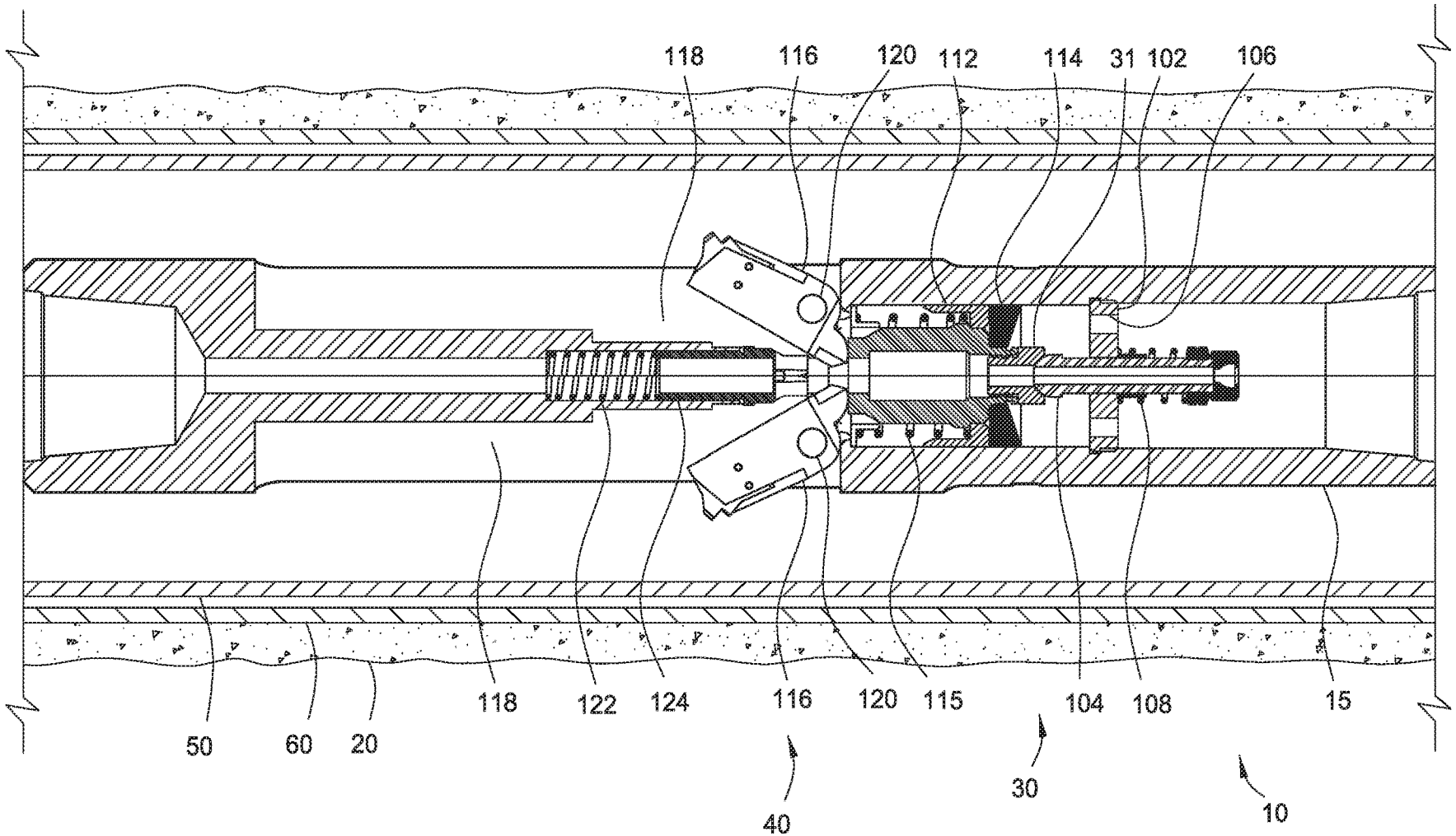
FIG. 1B is a cross sectional view of the tool of FIG. 1A in a second position.
Figure 1C:
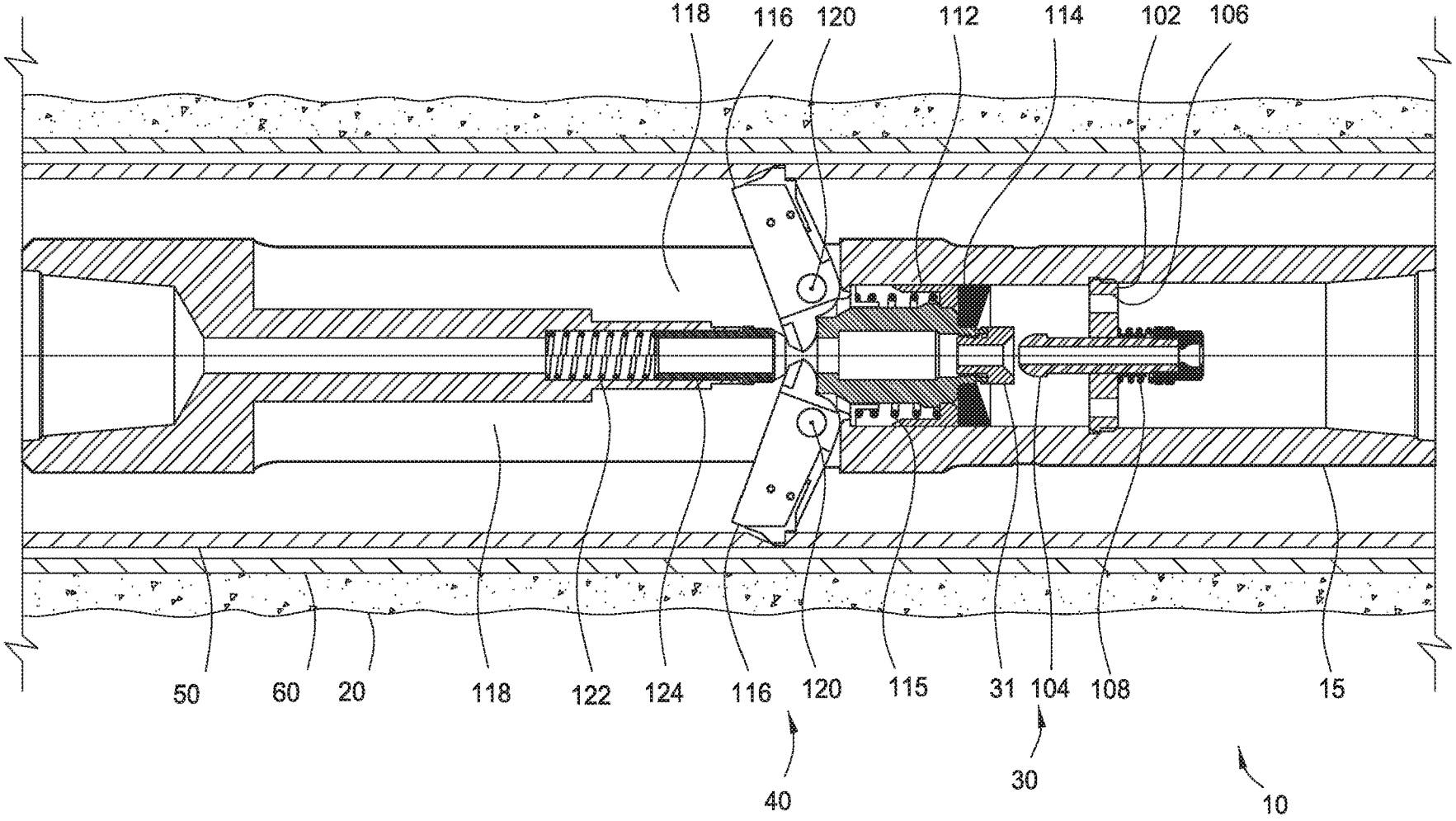
FIG. 1C is a cross sectional view of the tool of FIG. 1A in a third position.
Figure 3:
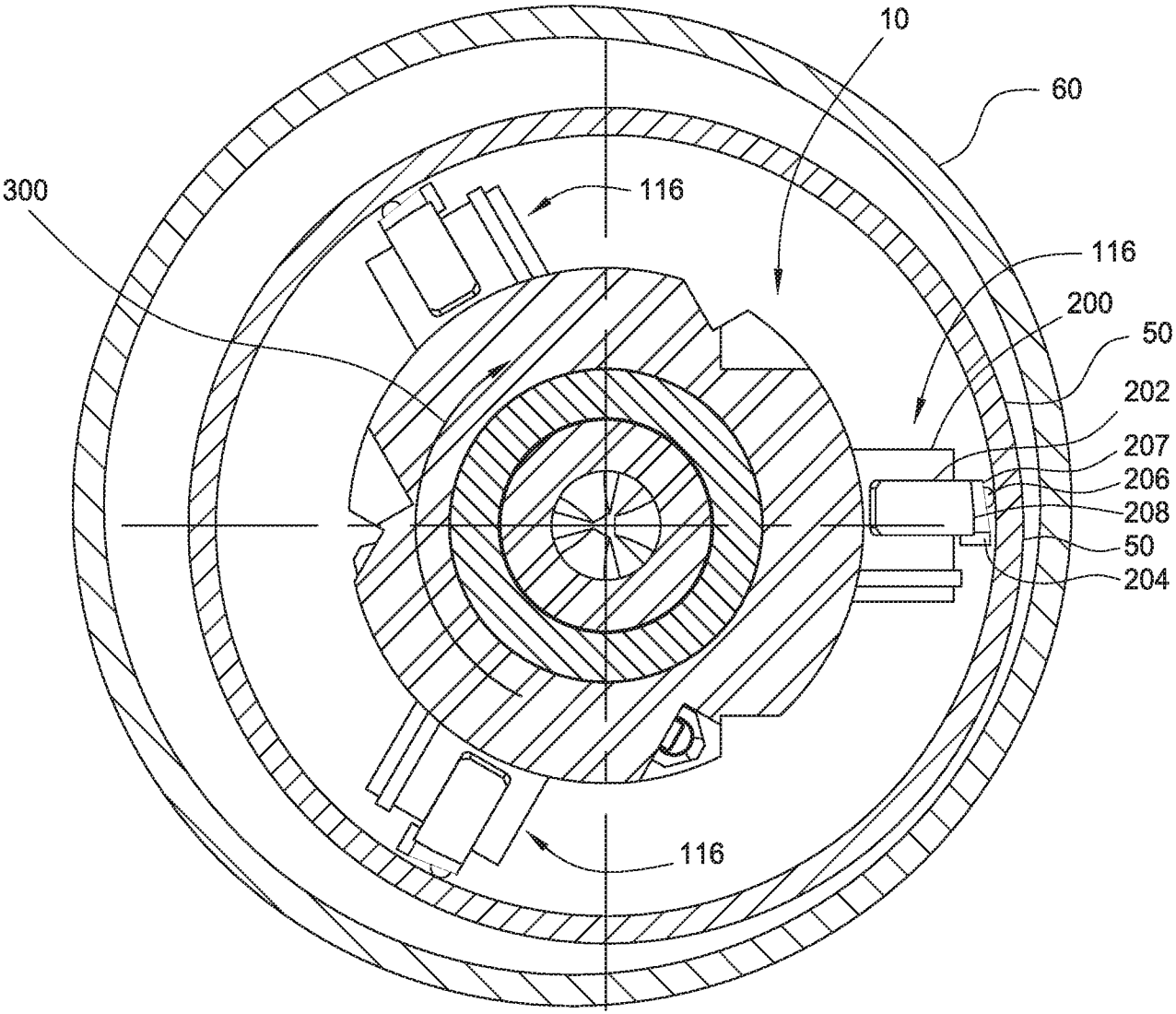
FIG. 3 is a top cross sectional view of the tool of FIG. 1A, wherein the blade is in contact with the inner tubular.

The blade assembly 40 includes at least one blade 116 in a respective recess 118 of the housing 15, as shown in FIG. 1A. Any appropriate number of blades 116 may be used in the blade assembly 40. In some embodiments, the number of blades 116 ranges from 2 to 10. In other embodiments, the number of blades 116 ranges from 3 to 6. In yet other embodiments, the number of blades 116 ranges from 2 to 4. Each blade 116 is rotatable with respect to the tool 10, for example about a pivot point 120, between a retracted position (FIG. 1A) and a series of extended positions (FIGS. 1B, 1C, and 3). In the retracted position, the blade 116 is disposed in the recess 118. In an extended position, the blade 116 is at least partially extended outward from the recess 118. In some embodiments, the blade 116 extends radially outward from the longitudinal axis of cutting tool 10. In one embodiment, the blades 116 are biased towards the retracted position, for example by a spring 122, which urges a bushing 124 against an inner surface of the blades 116. For example, the spring 122 urges the bushing 124 against an end of each blade 116 such that the blades 116 rotate about the pivot point 120 into the retracted position. In some embodiments, the blade assembly 40 includes a bumper, ratchet, catch plate, group thereof, or other component(s) configured to limit the extension of blade 116. A person of ordinary skill in the art with the benefit of this disclosure would appreciate that other configurations of blade assemblies 40 and actuator assemblies 30 could serve to provide one or more blades that move from a retracted position to an extended position within the spirit of this disclosure.

Figure 2A:
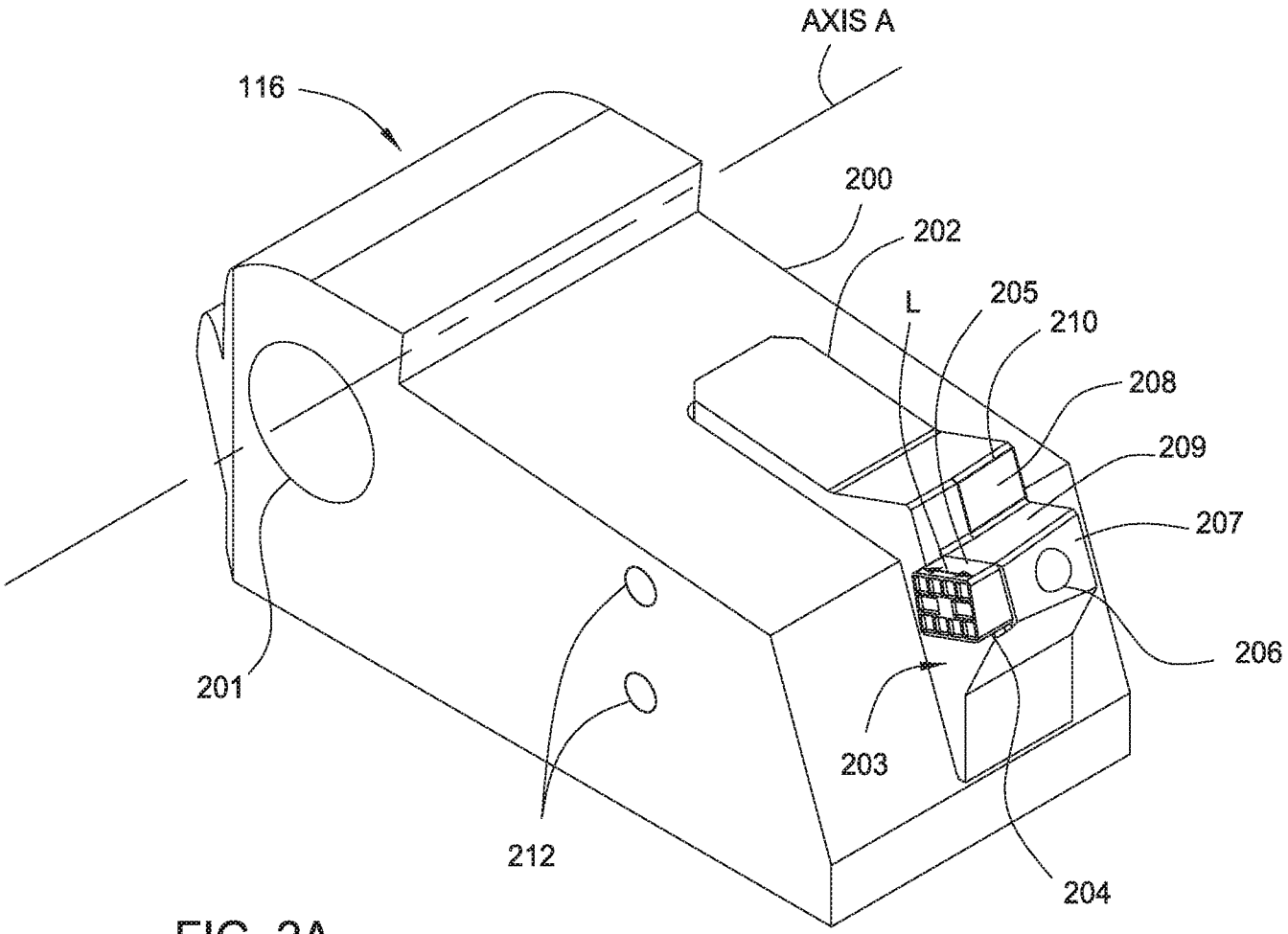
FIG. 2A illustrates an exemplary embodiment of a blade on the tool of FIG. 1A.
Figure 2B:
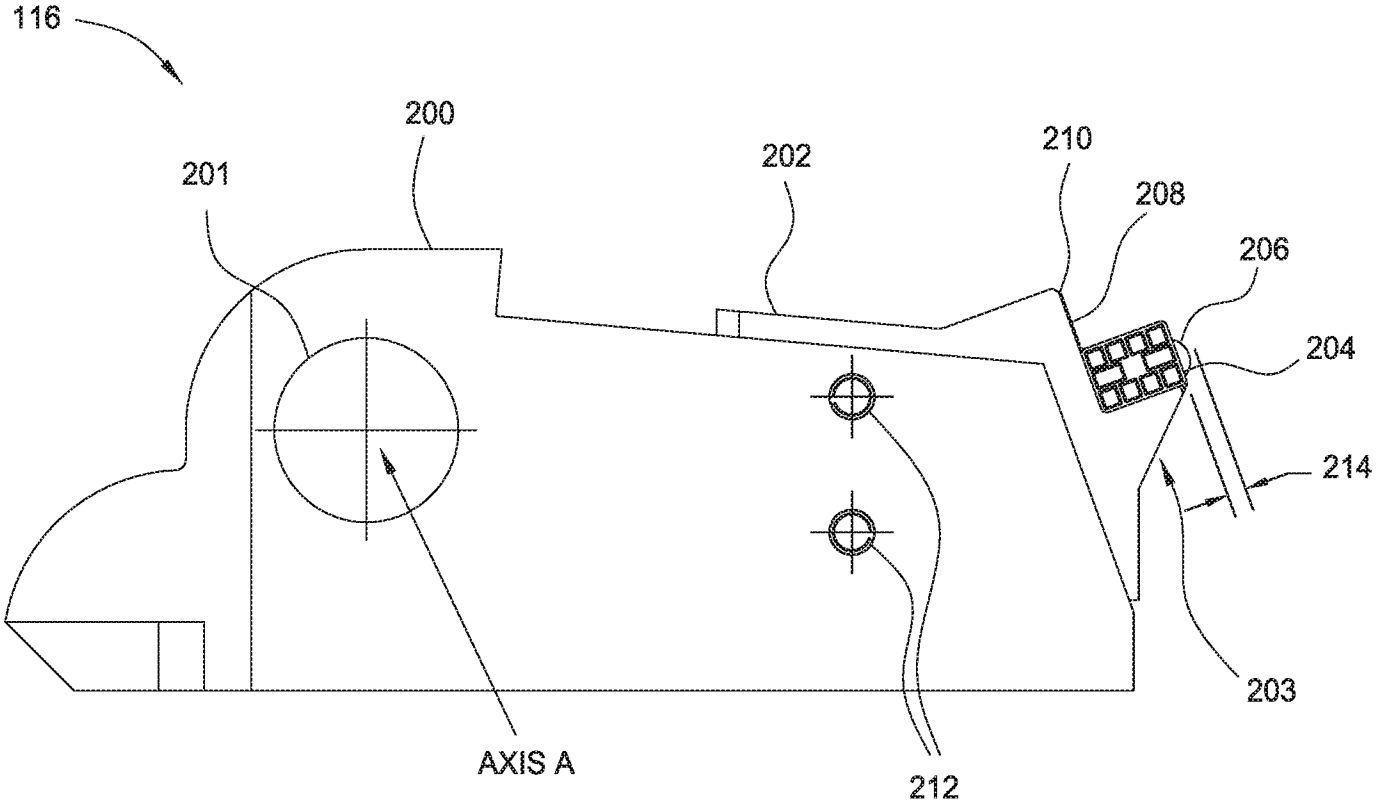
FIG. 2B is a side view of the blade of FIG. 2A.

An exemplary embodiment of the blade 116 is shown in FIGS. 2A and 2B. The blade 116 includes a blade body 200 with an aperture 201 for receiving a pivot pin at pivot point 120. The blade 116 also includes an attachment 202. In one embodiment the blade body 200 and the attachment 202 are integrally formed. In another embodiment, the attachment 202 is operably coupled to the blade body 200. For example, the blade body 200 includes a slot for receiving the attachment 202. The attachment 202 may be fastened in the slot of the blade body 200 using any appropriate fastener, such as a pin and/or a screw. In one embodiment, the blade body 200 includes holes 212 for receiving the fasteners, as shown in FIGS. 2A and 2B. In one embodiment, the attachment 202 is replaceable. For example, the attachment 202 may have a useful life defined by the ability of the attachment 202 to cut through an entire wall thickness of the inner tubular 50 as described herein. After exhausting the useful life of the attachment 202, the attachment 202 may be unfastened and removed from the blade body 200. Thereafter, a new attachment 202 may be fastened to the blade body 200. When blade body 200 and the attachment 202 are integrally formed, after exhausting the useful life of the attachment 202, the attachment 202 may be reconditioned, for example by welding, coating, milling, sharpening, etc. In one embodiment, the attachment 202 is adjustable in the slot of the blade body 200. For example, the attachment 202 may be unfastened and moved to a new position relative to the blade body 200 to change or improve how the blade 116 engages the inner tubular 50 as described herein. After the adjustment, the attachment 202 may again be fastened to the blade body 200.

The attachment 202 includes a cutting structure 204 configured to cut a tubular, such as the inner tubular 50. In some embodiments, cutting structure 204 is configured to cut through a tubular, thereby making a full-thickness cut. In some embodiments, cutting structure 204 is configured to make a partial-thickness cut, thereby reducing the thickness of the tubular at the proximity of the cut. Cutting structure 204 may be configured to cut the tubular with a desired shape or geometry, such as a groove, dovetail, or other desired cut shape or profile. In some embodiments, cutting structure 204 cuts a profile into the tubular that prepares the tubular for subsequent device latching. In some embodiments, cutting structure 204 cuts a notch into the tubular, thereby scoring the tubular for later axial separation at the proximity of the cut. In some embodiments, the profile may be a substantially uniform (within +/−10%) feature machined into the inner wall of the tubular. Cutting structure 204 may cut the tubular in any fashion that removes material, including milling, grinding, machining, chipping, boring, plaining, shaving, etc. In one embodiment, the attachment 202 includes a protrusion 203. The cutting structure 204 may be disposed on the protrusion 203 of the attachment 202. The protrusion 203 extends outward, as shown in FIGS. 2A and 2B. In some embodiments, rotational axis A serves as pivot point 120. In some embodiments, the blade 116 includes a pivot pin in aperture 201 along axis A. In some embodiments, as the blade 116 extends radially outward from the longitudinal axis of cutting tool 10, the cutting structure 204 moves upward within the tubular. Consequently, the amount of extension of the blade 116 from the cutting tool 10 may be expressed as a measurement of rotation angle about axis A. The cutting structure 204 is disposed on a leading edge of the protrusion 203 of the blade body 200 such that the cutting structure 204 cuts the inner tubular 50 when the tool 10 rotates 300 about its longitudinal axis and the blade 116 is in an extended position, as shown in FIG. 3. The sweep of the tool 10 is the diameter of the circle formed by the outermost extension of the cutting structure 204 as the tool 10 rotates 300 about its longitudinal axis. The cutting structure 204 may be disposed in a groove formed at the leading edge of the protrusion 203 of the blade body 200. In one embodiment, a top surface 205 of the cutting structure 204 is flush with a top surface 209 of the protrusion 203. The cutting structure 204 includes any suitable material suitable for cutting the inner tubular 50. In one embodiment, the cutting structure 204 includes at least one carbide insert, as shown in FIGS. 2A and 2B. In another embodiment, the cutting structure 204 includes crushed carbide in a braze matrix. In yet another embodiment, the cutting structure 204 includes at least one polycrystalline diamond compact insert. The cutting structure 204 may be brazed onto the attachment 202 using any suitable material, such as a copper nickel alloy. For any given tubular, a suitable cutting structure 204 may include any material that is at least as hard as the material of the inner surface of that tubular.

In some embodiments, attachment 202' may include a non-cutting structure 204' in place of cutting structure 204. Non-cutting structure 204' may be dimensionally similar to cutting structure 204, however non-cutting structure 204' may be configured to deform the tubular, displacing rather than removing material therefrom. Non-cutting structure 204' may be configured to deform the tubular with a desired shape or geometry, such as a groove, dovetail, or other desired deformation shape or profile. In some embodiments, non-cutting structure 204' deforms a profile into the tubular that prepares the tubular for subsequent device latching. In some embodiments, the profile may be a substantially uniform (within +/−10%) feature pressed into the inner wall of the tubular.

Figure 5:
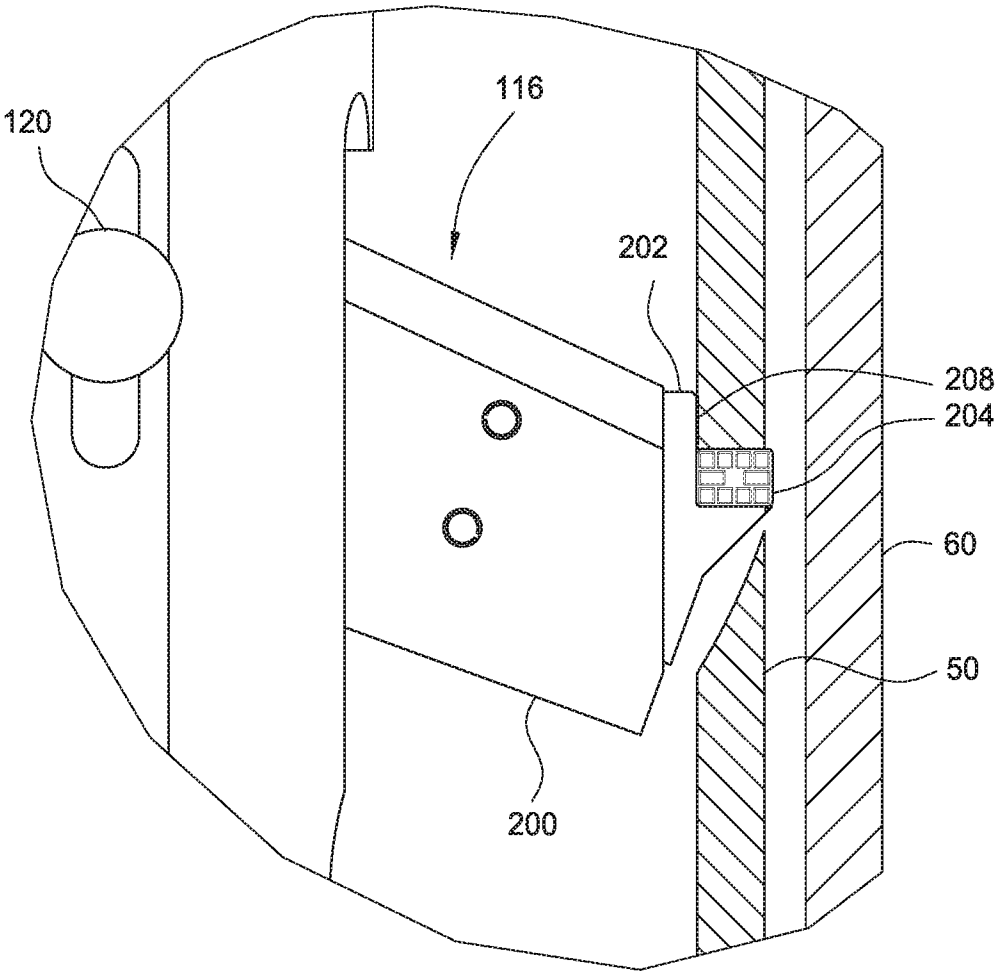
FIG. 5 is an enlarged, side view of the blade of FIG. 1C.

The attachment 202 may be modified to accommodate for the anticipated wear of the cutting structure 204. The attachment 202 may also be modified to accommodate for cutting through tubulars of various thicknesses. For example, a plurality of carbide inserts may be combined to form a cutting structure 204 having a length L at least as long as the thickness of the inner tubular 50 at the proximity of the cut. The length L of the cutting structure 204 may also be selected such that the cutting structure 204 does not substantially contact or cut outer tubular 60, thereby avoiding damaging the outer tubular 60, when the blade 116 has cut through the inner tubular 50, as shown in FIGS. 1C and 5. For example, substantial contact includes cutting through more than 25% of the thickness of the outer tubular 60 at the proximity of the cut. In another example, substantial contact includes cutting through more than 15% of the thickness of the outer tubular 60 at the proximity of the cut. In yet another example, substantial contact includes cutting through more than 10% of the thickness of the outer tubular 60 at the proximity of the cut. In some embodiments, the length L of the cutting structure 204 ranges from 1/32 inches to 1/2 inches greater than the thickness of the inner tubular 50 at the proximity of the cut. In other embodiments, the length L of the cutting structure 204 ranges from 1/16 inches to 1/8 inches greater than the thickness of the inner tubular 50 at the proximity of the cut.

The attachment 202 may include a stop 208 configured to limit the extension of the blade 116, and thereby limit the sweep of the tool 10. The stop 208 may be positioned on an outward-facing surface of the attachment 202, as shown in FIGS. 2A and 2B. The stop 208 may be positioned adjacent the cutting structure 204. In one example, the stop 208 is positioned above the cutting structure 204. In another example, the stop 208 is positioned below the cutting structure 204. At least a portion of the stop may be made of a low-friction material. In one embodiment, the stop 208 is configured to limit a depth of cut of the cutting structure 204. The depth of cut is defined by a radial (with respect to the longitudinal axis of the tubular) cutting distance extending from the stop 208 to the edge of cutting structure 204. The stop 208 may be formed at an angle relative to the top surface 205 of the cutting structure 204. In some embodiments, the angle between the stop 208 and the top surface 205 of the cutting structure 204 ranges from 60 degrees to 90 degrees, from 90 degrees to 120 degrees, and/or from 60 degrees to 120 degrees. In other embodiments, the angle ranges from 80 degrees to 90 degrees, from 90 degrees to 110 degrees, and/or from 80 degrees to 110 degrees. In yet other embodiments, the angle ranges from 85 degrees to 90 degrees, from 90 degrees to 95 degrees, and/or from 85 degrees to 95 degrees. In some embodiments, the stop 208 may be configured to limit the extension of the blade 116, and thereby limit the sweep of the tool 10, to produce a partial thickness cut in the inner tubular 50. In some embodiments, the stop 208 may be configured to limit the extension of the blade 116, and thereby limit the sweep of the tool 10, to make a full-thickness cut (cut through) inner tubular 50, while preventing a substantial cut in the outer tubular 60. In one embodiment, a carbide rod is brazed onto the stop 208 and provides a low-friction surface against the inner tubular 50 when the blade 116 has cut through the inner tubular 50. For example, a longitudinal axis of the carbide rod is parallel or substantially parallel with a longitudinal axis of the inner tubular 50 when the blade 116 has cut through the inner tubular 50. In another embodiment, the stop 208 includes a low-friction surface, such as a layer of smooth hard metal. For example, the stop 208 includes a hardfacing alloy 210 that is bonded to the attachment 202 using a laser and/or plasma arc process as is known in the art. The hardfacing alloy 210 may provide a low-friction surface against the inner tubular 50 when the blade 116 has cut through the inner tubular 50. The hardfacing alloy 210 may be configured to not cut the inner tubular 50. The hardfacing alloy 210 may have a non-uniform thickness. For example, the hardfacing alloy 210 may include a contoured profile corresponding to the inner tubular 50. Alternatively, the hardfacing alloy 210 may have a uniform thickness, as shown in FIG. 2B. In some embodiments, a thickness of the hardfacing alloy 210 ranges from 0.005 inches to 0.02 inches. In other embodiments, the thickness of the hardfacing alloy 210 ranges from 0.008 inches to 0.012 inches.

The attachment 202 of blade 116 also may include an initial engagement point, for example a wearable member 206, configured to contact the tubular prior to other portions or components of blade 116. The initial engagement point thereby may prevent the deformation and/or chipping of the cutting structure 204. As such, the initial engagement by wearable member 206 guides the cutting structure into contact with the tubular. For example, the wearable member 206 may act to cushion the impact between the blade 116 and the inner tubular 50. In one embodiment, the wearable member 206 is disposed on a outward-facing surface of the cutting structure 204. In another embodiment, the wearable member 206 is disposed on a outward-facing surface, such as outer surface 207 of the protrusion 203, as shown in FIG. 2A. The outer surface 207 may be parallel or, alternatively, angled relative to the stop 208 as shown in FIG. 3. In one embodiment, the wearable member 206 is centered on the outer surface 207. In another embodiment, the wearable member 206 is positioned on the outer surface 207 towards the leading edge of the blade body 200. The wearable member 206 includes any appropriate material, such as metal alloy. Exemplary materials in the wearable member 206 include nickel, silver solder, rubber, elastomer, and/or epoxy. The wearable member 206 may have any appropriately shaped outer surface, such as a rounded outer surface as shown in FIGS. 2A and 2B. In one embodiment, the wearable member 206 is spherically shaped. For example, the outer surface 207 of the protrusion 203 includes a groove therein for receiving the spherically shaped wearable member 206. The spherically shaped wearable member 206 is bonded to the attachment 202 in the groove. In another embodiment, the wearable member 206 is hemispherically shaped. For example, a flat side of the hemispherically shaped wearable member 206 may be bonded to the outer surface 207 of the protrusion 203. The wearable member 206 may have a thickness 214 measured from the outer surface 207 of the protrusion 203 to an apex of the wearable member 206, as shown in FIG. 2B. The thickness 214 of the wearable member 206 is selected in order to provide a gradual engagement between the cutting structure 204 and the tubular inner 50, or to guide cutting structure 204 into contact with inner tubular 50 as described herein. In some embodiments, the thickness 214 of the wearable member 206 ranges from 0.05 inches to 0.3 inches. In other embodiments, the thickness 214 of the wearable member 206 ranges from 0.10 inches to 0.15 inches.

During operation, the tool 10 may be lowered into the inner tubular 50 with the blades 116 in the retracted position. In one embodiment, the tubular 50 is tubing disposed in casing. In another embodiment, the inner tubular 50 is casing/liner disposed in the wellbore 20. In yet another embodiment, the inner tubular 50 is an inner casing/liner disposed in an outer casing/liner, such as outer tubular 60, as shown in FIG. 1A. Cement may or may not be disposed on an outer surface of any one or more of the nested tubulars. In one embodiment, the inner tubular 50 and the outer tubular 60 are concentrically aligned in the wellbore 20. In another embodiment, the inner tubular 50 and the outer tubular 60 are not concentrically aligned, as shown in FIG. 3. The tool 10 may be positioned at a desired depth. As shown in FIG. 1A, the inner and outer tubulars 50, 60 may overlap at the desired depth. Thereafter, the blades 116 may be extended outwardly, as shown in FIG. 1B. The blades 116 may thereby extend radially outwardly relative to the longitudinal axis of cutting tool 10, and the cutting structure 204 may move upwardly within the tubulars 50, 60.

Actuation assembly 30 may act to extend blades 116 of the blade assembly 40. In some embodiments, actuation assembly 30 is hydraulic. To actuate the blades 116 into an extended position, fluid is injected through the tool 10. A first portion of the injected fluid enters the bore of the movable member 104 before entering the larger bore of the piston 112. Thereafter, the first portion of fluid passes through a bottom of the housing 15. A second portion of the injected fluid passes through the apertures 106 of the retaining member 102 and may act on the packing seal 114 of the piston 112. Fluid pressure in the housing 15 is increased, thereby moving the movable member 104 downward and compressing the spring 108 against the retaining member 102. In turn, the movable member 104 urges the piston 112 downward, thereby compressing the spring 115. The piston 112 acts on the blades 116, thereby actuating the blades 116 into an extended position. FIG. 1B shows the blades 116 extending toward the inner tubular 50. In this example, a bottom of the piston 112 acts on a shoulder of each blade 116, thereby causing each blade 116 to rotate about its respective pivot point 120. As would be apparent to one of ordinary skill in the art with the benefit of this disclosure, actuation assembly 30 can be other than hydraulic while still being capable of selectively extend blades 116 of the blade assembly 40. For example, actuation assembly 30 could be an electromagnetic device.

In one embodiment, the tool 10 provides an indication at the surface of the wellbore 20 that the blades 116 have cut through the inner tubular 50. For example, the actuation assembly 30 is configured such that the movable member 104 and the piston 112 disengage when the blades 116 cut through the wall of the inner tubular 50. Upon cutting through the inner tubular 50, the movable member 104 reaches a stop and the fluid acting on the piston surface of the piston 112 causes the piston 112 to move downward relative to the movable member 104. As a result, the piston 112 disengages from the bottom surface of the movable member 104, as shown in FIG. 1C. In turn, the second portion of the injected fluid enters the bore of the piston 112 and causes the fluid pressure in the housing 15 to decrease. In one embodiment, the pressure drop corresponds to the blades 116 being perpendicularly positioned relative to the inner tubular 50, thereby indicating that the blades 116 have cut through the inner tubular 50. In another embodiment, the pressure drop corresponds to the blades 116 having cut through the inner tubular 50. As would be apparent to one of ordinary skill in the art with the benefit of this disclosure, actuation assembly 30 can be other than hydraulic while still being capable of providing an indication at the surface of the wellbore 20 that the blades 116 have cut through the inner tubular 50 and responding appropriately.

Upon indication that the blades 116 have cut through the inner tubular 50, the blades 116 are returned to the retracted position. In some embodiments, to return the blades 116 to the retracted position, fluid pressure in the housing 15 may be decreased. As a result, the spring 115 may overcome the fluid force acting on the packing seal 114. The piston 112 is urged upwards into engagement with the bottom surface of the movable member 104. By moving upwards, the piston 112 disengages from the blades 116 and the spring 122 urges the blades 116 into the retracted position.

Figure 4:
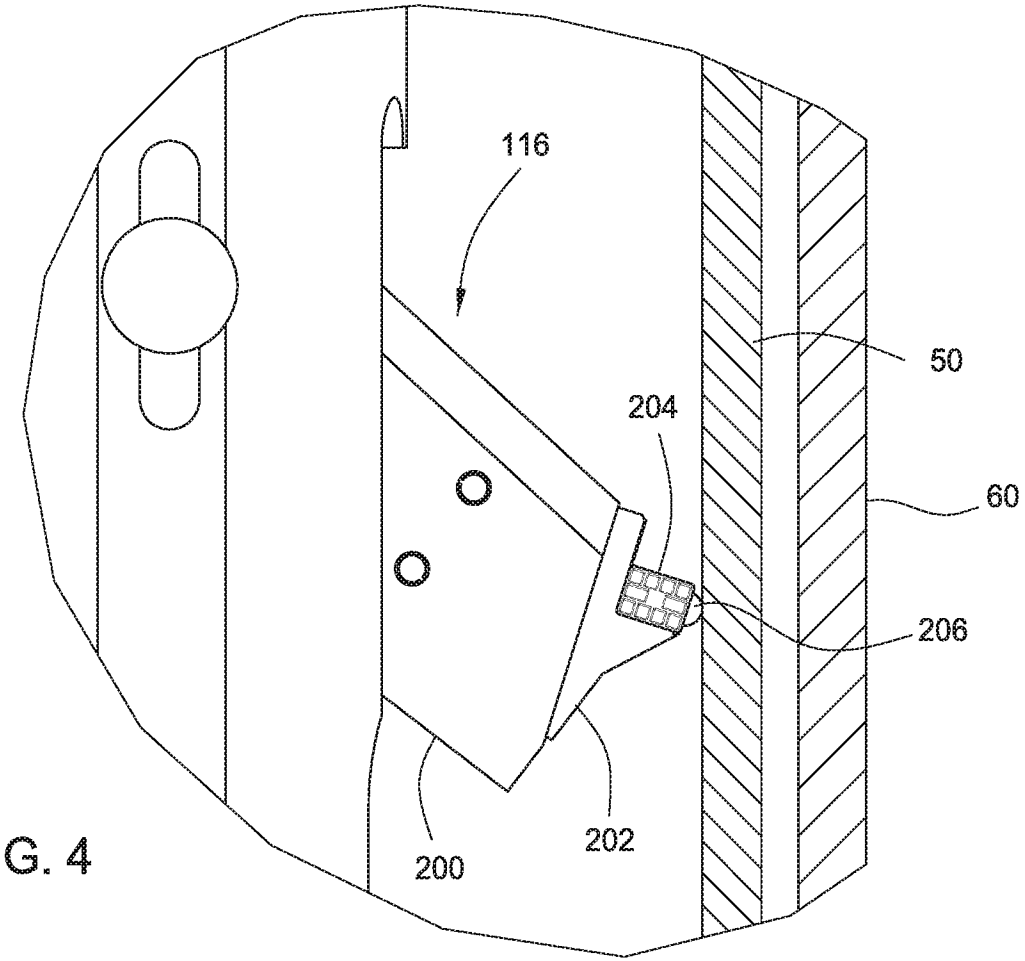
FIG. 4 is an enlarged, side view of the blade of FIG. 3.

In one embodiment, the wearable member 206 is positioned between the cutting structure 204 and the inner tubular 50 when the blade 116 engages the inner tubular 50, as shown in FIG. 4. As such, when the blade 116 initially engages the inner tubular 50, the wearable member 206 protects the cutting structure 204 from impact against the inner tubular 50. For example, upon actuation by the actuation assembly 30, the blade 116 may engage the inner tubular 50 with such intensity that, in the absence of wearable member 206, the cutting structure 204 may deform and/or chip. Due to the position of the wearable member 206 relative to the cutting structure 204, the wearable member 206 may absorb all or substantially all of the impact between the blade 116 and the inner tubular 50, thereby preventing deformation and/or chipping of the cutting structure 204. In one example, the cutting structure 204 does not contact the inner tubular 50 when the blade 116 initially engages the inner tubular 50. As a result, the wearable member 206 absorbs all of the impact between the blade 116 and the inner tubular 50. In another example, the wearable member 206 and the cutting structure 204 both contact the inner tubular 50 when the blade 116 initially engages the inner tubular 50. As a result, the wearable member 206 may absorb substantially all of the impact between the blade 116 and the inner tubular 50.

In one embodiment, the tool 10 is rotated relative to the inner tubular 50 while the blades 116 are extending toward the inner tubular 50. In one embodiment, a mud motor rotates the tool 10.

As the tool 10 rotates, the wearable member 206 may protect the cutting structure 204 by deforming temporarily or permanently. For example, the thickness of the wearable member 206 may gradually decrease during the rotation of the tool 10. In one embodiment, the thickness of the wearable member 206 may decrease by 5% to 25% per revolution. In another embodiment, the thickness of the wearable member 206 may decrease by 10% to 20% per revolution. In one embodiment, the wearable member 206 may flatten during the rotation of the tool 10. In another embodiment, the wearable member 206 may wear away. As a result, the wearable member 206 may guide the cutting structure 204 into contact with the inner tubular 50 by allowing the blade 116 to extend to and into the inner tubular 50. By guiding the cutting structure 204 into contact with the inner tubular 50, the wearable member 206 prevents interrupted cutting. In one embodiment, interrupted cutting happens when the tool 10 skips, jumps, and/or bumps against a surface. For example, abrupt contact between the cutting structure 204 and the inner tubular 50 may cause at least one of the blades 116 to temporarily disengage from the inner tubular 50. This is referred to as a jump. After the jump, the tool 10 may experience a bump. For example, the tool 10 bumps the inner tubular 50 when the blade 116 reengages the inner tubular 50 with such intensity that the cutting structure 204 on the blade 116 is subject to deforming and/or chipping. In one embodiment, the tool 10 may bump the inner tubular 50 without deforming and/or chipping the cutting structure 204 on the blade 116. Due to the composition and dimensions of the wearable member 206, the cutting structure 204 may avoid abrupt contact with the inner tubular 50. As a result, the wearable member 206 may prevent the deformation and/or chipping of the cutting structure 204. In one embodiment, the entire thickness of the wearable member 206 may wear away or flatten before the cutting structure 204 engages the inner tubular 50. In another embodiment, only a portion of the thickness of the wearable member 206 wears away or flattens before the cutting structure 204 engages the inner tubular 50.

As the cutting structure 204 cuts the inner tubular 50, the blade 116 may further extend, for example by rotating about the pivot point 120, thereby increasing the sweep of the tool 10. For example, the actuation assembly 30 may act to provide a constant downward force on the shoulders of the blade 116 during cutting, which urges the blade 116 into further extension. As a result, the cutting structure 204 cuts through the inner tubular 50, as shown in FIG. 5. In one embodiment, the top surface 205 of the cutting structure 204 is perpendicular or substantially perpendicular to the longitudinal axis of the inner tubular 50 when the cutting structure 204 cuts through the inner tubular 50. In some embodiments, the blade 116 may rotate 90° about axis A from the retracted position to the extended position wherein cutting structure 204 is perpendicular or substantially perpendicular to the longitudinal axis of the inner tubular 50.

After the cutting structure 204 has made the desired cut to inner tubular 50, for example making a full-thickness cut through the inner tubular 50, extension of the blade 116, and consequently sweep of the tool 10, is limited regardless of the fluid pressure in the housing 15. For example, the stop 208 may engage the inner tubular 50 when the cutting structure 204 cuts through the inner tubular 50, thereby preventing the blade 116 from substantially damaging the structural integrity of the outer tubular 60. Thereafter, the stop 208 may remain engaged with the inner tubular 50. As a result, the stop 208 stabilizes the tool 10 in the inner tubular 50. For example, the stop 208 prevents interrupted cutting by providing continuous engagement between the tool 10 and the inner tubular 50. In one embodiment, the stop 208 prevents any engagement between the blade 116 and the outer tubular 60 when the blade 116 has cut through the inner tubular 50, as shown in FIG. 5. In another embodiment, the stop 208 prevents significant engagement between the blade 116 and the outer tubular 60. In one example, significant engagement includes cutting through more than 25% of the thickness of the outer tubular 60 at the proximity of the cut. In another example, significant engagement includes cutting through more than 15% of the thickness of the outer tubular 60 at the proximity of the cut. In yet another example, significant engagement includes cutting through more than 10% of the thickness of the outer tubular 60 at the proximity of the cut. In some embodiments, after the stop 208 engages inner tubular 50, the rotation of blade 116 about axis A does not increase. For example, the action of actuation assembly 30 may not further extend blade 116 after the stop 208 engages inner tubular 50. In some embodiments, after the stop 208 engages inner tubular 50, the sweep of tool 10 is limited and does not increase when actuation assembly 30 actuates piston 112, for example, when fluid pressure in the housing 15 changes. In some embodiments, after the cutting structure 204 has cut through the inner tubular 50, increase in either the rotation of the blade 116 about axis A or the sweep of the tool 10 is limited and prevented from increasing when actuation assembly 30 actuates piston 112, for example, when the fluid pressure in the housing 15 changes. The stop 208 may stabilize the Engagement of the stop 208 with the inner tubular 50 may provide a more uniform cut. For example, by preventing interrupted cutting, engagement of the stop 208 with the inner tubular 50 may result in less damage around the cut, such as pitting, chipping, or splintering. Likewise, the engagement of stop 208 may prevent torque spikes while rotating the tool 10.

In one embodiment, when the tool 10 is positioned at the proper depth in the inner tubular 50, the tool 10 is not centralized in the inner tubular 50. This may result in an unevenly distributed cut wherein the rotating blades 116 contact only a portion of the inner tubular 50. For example, a mule shoe cut may result. As a result, the blades 116 may create a cut that spans only a portion of the circumference of the inner tubular 50.

In one embodiment, the actuation assembly 30 provides an evenly distributed cut by actuating the blades 116 into an extended position, as shown in FIG. 3. For example, the piston 112 of the actuation assembly 30 may provide a substantially equal (within +/−10%) force on the shoulder of each blade 116 such that each blade 116 engages the inner tubular 50 with a substantially equal radial force. The radial forces from the blades 116 may cause the tool 10 to move laterally, thereby causing each blade 116 to engage the inner tubular 50. For example, in the event that tool 10 is not centralized in inner tubular 50, the radial forces from the blades 116 engaging with inner tubular 50 may cause the tool 10 to move laterally, thereby repositioning tool 10 to be more centralized in inner tubular 50. In another embodiment, the stop 208 is configured to limit the extension of the blade 116, thereby providing an evenly distributed cut. For example, the stop 208 may provide a radial force against the inner tubular 50 causing the tool 10 to move laterally in response. In one embodiment, the stop 208 centralizes the tool 10 in the inner tubular 50 by moving the tool 10 laterally. In turn, the tool 10 engages each blade 116 with the inner tubular 50. As a result, the cut created by the tool 10 spans the entire circumference of the inner tubular 50.

In one embodiment, after the tool 10 cuts through the inner tubular 50 and along the entire circumference of the inner tubular 50, a portion of the inner tubular 50 below the cut formed by the tool 10 is allowed to fall downward in the wellbore 20. For example, the portion of the inner tubular 50 below the cut falls into a cavern at a lower end of the wellbore 20.

Thereafter, the blades 116 may be retracted and the cutting operation described herein may be repeated any number of times. For example, the tool 10 may be moved axially upward in the wellbore 20 the inner tubular 50 may be cut into shorter portions.

As will be understood by those skilled in the art, a number of variations and combinations may be made in relation to the disclosed embodiments all without departing from the scope of the invention.

In one embodiment, a method of cutting a tubular includes providing a rotatable cutting tool in the tubular, the cutting tool having a blade with a cutting structure thereon; extending the blade relative to the cutting tool; rotating the cutting tool relative to the tubular; guiding the cutting structure into contact with the tubular; cutting the tubular using the blade; and limiting extension of the blade.

In one or more of the embodiments described herein, an actuation assembly acts to extend the blade relative to the cutting tool.

In one or more of the embodiments described herein, the actuation assembly is hydraulic, the method further comprising limiting extension of the blade regardless of a fluid pressure in the housing of the cutting tool.

In one or more of the embodiments described herein, limiting extension of the blade comprises engaging a stop with the tubular.

In one or more of the embodiments described herein, a method of cutting a tubular includes at least one of: stabilizing the cutting tool by engaging the stop with the tubular, laterally moving the cutting tool by engaging the stop with the tubular, and centralizing the cutting tool by engaging the stop with the tubular.

In one or more of the embodiments described herein, the extending the blade relative to the cutting tool happens while at least one of: the rotating the cutting tool relative to the tubular, the guiding the cutting structure into contact with the tubular, a moving the cutting structure upward within the tubular, and a pivoting the blade about a pivot point.

In one or more of the embodiments described herein, guiding the cutting structure into contact with the tubular includes making initial contact with the tubular with a wearable member on the blade.

In one or more of the embodiments described herein, rotating the cutting tool includes deforming the wearable member.

In one or more of the embodiments described herein, guiding the cutting structure into contact with the tubular includes decreasing a thickness of the wearable member.

In one or more of the embodiments described herein, the cutting the tubular using the blade comprises a full-thickness cut, and the limiting extension of the blade follows the full-thickness cut.

In one or more of the embodiments described herein, a method of cutting a tubular includes providing a second tubular surrounding the tubular; and after cutting through the tubular using the blade, avoiding damaging the second tubular with the cutting tool.

In one embodiment, a rotatable blade for cutting a tubular includes a blade body extendable from a retracted position; a cutting structure disposed on a leading edge of the blade body, the cutting structure configured to cut the tubular; a stop on a first surface of the blade body; and an initial engagement point on a second surface of the blade body, the initial engagement point configured to guide the cutting structure into contact with the tubular.

In one or more of the embodiments described herein, the first surface of the blade body is the same as the second surface of the blade body.

In one or more of the embodiments described herein, at least one of the first surface and the second surface is an outward-facing surface.

In one or more of the embodiments described herein, the stop comprises a low-friction material.

In one or more of the embodiments described herein, the initial engagement point comprises wearable member.

In one or more of the embodiments described herein, the stop is configured to limit at least one of: an extension of the blade body, and a depth of cut of the cutting structure.

In one or more of the embodiments described herein, the blade is rotatable about a pivot point.

In one or more of the embodiments described herein, a rotatable blade for cutting a tubular includes a pivot pin, wherein the blade is rotatable about the pivot pin.

In one or more of the embodiments described herein, the stop is disposed at an angle relative to a top surface of the cutting structure.

In one or more of the embodiments described herein, the cutting structure includes at least one of: a carbide insert, a polycrystalline diamond compact insert, and crushed carbide in a braze matrix.

In one or more of the embodiments described herein, a length of the cutting structure at least as long as a thickness of the tubular.

In one or more of the embodiments described herein, the cutting structure, the stop, and the initial engagement point are disposed on an attachment.

In one or more of the embodiments described herein, the attachment is at least one of: integrally formed with the blade body, operably coupled to the blade body, and replaceable.

In one embodiment, a method of cutting a tubular includes positioning a rotatable cutting tool in the tubular, the cutting tool having a blade and a cutting structure; extending the blade relative to the cutting tool; rotating the cutting tool relative to the tubular; guiding the cutting structure into contact with the tubular; cutting the tubular using the cutting structure; and limiting a sweep of the cutting structure.

In one or more of the embodiments described herein, the cutting tool further has a plurality of blades extendable relative to the cutting tool.

In one or more of the embodiments described herein, a length of the cutting structure is at least as long as a thickness of the tubular at a proximity of the cutting.

In one or more of the embodiments described herein, limiting the sweep includes selecting an angle between the cutting structure and a stop of the blade.

In one or more of the embodiments described herein, a method of cutting a tubular includes avoiding damaging a second tubular surrounding the tubular after cutting through the tubular using the cutting structure.

In one or more of the embodiments described herein, the cutting the tubular comprises: making a partial-thickness cut; and cutting a profile into the tubular.

The invention claimed is:

1. A method of cutting a tubular, comprising:

providing a rotatable cutting tool in the tubular, the cutting tool having a blade body, the blade body including:

a protrusion with a cutting structure and an initial engagement point disposed thereon; and a stop;

extending the blade body relative to the cutting tool;

rotating the cutting tool relative to the tubular;

contacting the initial engagement point on the protrusion with the tubular, thereby guiding the cutting structure into contact with the tubular;

cutting the tubular using the blade body; and limiting extension of the blade body by engaging the stop with the tubular.

2. The method of claim 1, wherein an actuation assembly acts to extend the blade body relative to the cutting tool.

3. The method of claim 2, wherein the actuation assembly is hydraulic, the method further comprising limiting extension of the blade body regardless of a fluid pressure in the housing of the cutting tool.

4. The method of claim 1, further including at least one of:

stabilizing the cutting tool by engaging the stop with the tubular, laterally moving the cutting tool by engaging the stop with the tubular, and centralizing the cutting tool by engaging the stop with the tubular.

5. The method of claim 1, wherein the extending the blade body relative to the cutting tool happens while at least one of:

the rotating the cutting tool relative to the tubular, the guiding the cutting structure into contact with the tubular, a moving the cutting structure upward within the tubular, and a pivoting the blade about a pivot point.

6. The method of claim 1, wherein the initial engagement point on the protrusion comprises a wearable member.

7. The method of claim 6, wherein rotating the cutting tool includes deforming the wearable member.

8. The method of claim 6, wherein guiding the cutting structure into contact with the tubular includes decreasing a thickness of the wearable member.

9. The method of claim 1, wherein the cutting the tubular using the blade body comprises a full-thickness cut, and the limiting extension of the blade body follows the full-thickness cut.

10. The method of claim 1, further comprising:

providing a second tubular surrounding the tubular; and after cutting through the tubular using the blade body, avoiding damaging the second tubular with the cutting tool.

11. The method of claim 1, wherein the cutting tool further has a plurality of blade bodies extendable relative to the cutting tool.

12. The method of claim 1, wherein a length of the cutting structure is at least as long as a thickness of the tubular at a proximity of the cutting.

13. The method of claim 12, wherein limiting the sweep includes selecting an angle between the cutting structure and a stop of the blade.

14. The method of claim 1, further comprising avoiding damaging a second tubular surrounding the tubular after cutting through the tubular using the cutting structure.

15. The method of claim 1, wherein the cutting the tubular comprises:

making a partial-thickness cut; and cutting a profile into the tubular.

* * * * *